US005837413A

United States Patent [19]

Yada et al.

[11] Patent Number: 5,837,413

[45] Date of Patent: Nov. 17, 1998

[54] ELECTROPHOTOGRAPHIC TONER, AND DEVELOPER

[75] Inventors: Yoshio Yada; Naoki Ito, both of Akita, Japan

[73] Assignee: TDK Corporation, Tokyo, Japan

[21] Appl. No.: 975,460

[22] Filed: Nov. 21, 1997

[30] Foreign Application Priority Data

Nov. 29, 1996 [JP] Japan ..... 8-334758
Nov. 29, 1996 [JP] Japan ..... 8-334759

[51] Int. Cl.[6] ..... G03G 9/083
[52] U.S. Cl. ..... 430/106.6; 110/111
[58] Field of Search ..... 430/106.6, 110, 430/111

[56] References Cited

U.S. PATENT DOCUMENTS

| | | | |
|---|---|---|---|
| 4,904,558 | 2/1990 | Nagatsuka et al. | 430/106.6 |
| 5,354,640 | 10/1994 | Kanbayashi et al. | 430/110 |
| 5,672,454 | 9/1997 | Sasaki et al. | 430/106.6 |
| 5,698,357 | 12/1997 | Inoue et al. | 430/110 |
| 5,707,772 | 1/1998 | Akimoto et al. | 430/110 |

FOREIGN PATENT DOCUMENTS

| | | |
|---|---|---|
| 2-109058 | 4/1990 | Japan . |
| 4-452 | 1/1992 | Japan . |
| 4-40467 | 2/1992 | Japan . |
| 4-70847 | 3/1992 | Japan . |
| 4-340558 | 11/1992 | Japan . |

*Primary Examiner*—Roland Martin
*Attorney, Agent, or Firm*—Oblon, Spivak, McClelland, Maier & Neustadt, P.C.

[57] ABSTRACT

The invention provides a magnetic toner for electrophotography in which an ultrafine particle form of titanium oxide (having a specific surface area of 80 to 120 $m^2/g$, a degree of hydrophobicity of 50 to 80% by weight, and an alumina content of 0.4 to 1.1% by weight) made hydrophobic on its surface with an aluminum compound of a fatty acid, and a hydrophobic silica are externally added onto a magnetic toner particle, and which can provide images of high density and high quality over an extended period, with no filming observed on a photosensitive material. The invention also provides a developer for electrophotography in which 10 to 40 parts by weight of a carrier particle are mixed with 100 parts by weight of a magnetic toner wherein an ultrafine particle form of titanium oxide (having a specific surface area of 80 to 120 $m^2/g$, a degree of hydrophobicity of 50 to 80% by weight, and an alumina content of 0.4 to 1.1% by weight) made hydrophobic on its surface with an aluminum compound of a fatty acid, and a hydrophobic silica are externally added onto a magnetic toner particle, and which has high transfer efficiency, and can provide images of high density and high quality over an extended period, with no solid black image tone variations observed even at high temperature and humidity.

9 Claims, No Drawings

ELECTROPHOTOGRAPHIC TONER, AND DEVELOPER

BACKGROUND OF THE INVENTION

The present invention relates to an electrophotographic magnetic toner and developer for developing electrostatic latent images in electrophotography.

Among recently developed apparatuses making use of electrophotography, there are copiers, printers, and facsimiles, which employ three typical development processes, one using a two-component system comprising a toner, a carrier, etc., another using a magnetic monocomponent system relying on a toner containing a magnetic material therein without recourse to a carrier, and yet another using a non-magnetic monocomponent system relying on a toner having no magnetic material therein.

Generally, a toner for developers contains a finely divided powder form of silica, titanium oxide, etc. for the purpose of improving its fluidity. However, they are not only of insufficient charge stability but also are less than satisfactory in terms of the ability to impart fluidity to the toner.

To provide a solution to this problem, it has been proposed to treat the surfaces of finely divided titanium oxide powders with silicone oil, a coupling agent or the like, thereby making them hydrophobic and hence making improvements in charge stability, fluidity, and dispersibility, as disclosed typically in JP-A's 2-109058, 4-40467, 4-70847 and 4-340558.

However, such finely divided titanium oxide powders as proposed so far in the art are susceptible to agglomeration and so are not always effective for improvements in fluidity because a large amount of the surface treating agent should be used to make them so highly hydrophobic that charges are stabilized in various environments. Problems with using the finely divided titanium oxide powders with a magnetic toner are a transferability drop, a cleaning defect, and a filming defect on a photosensitive material. In addition, density or image quality drops due to long-term service or in environments of high temperature and humidity occur. This is also true of a developer containing both magnetic toner and carrier. That is, transferability drops, density variations, or density or image quality drops due to long-term service or in environments of high temperature and humidity occur.

One object of the present invention is to provide a magnetic toner for electrophotography which enables images of high density and high quality to be obtained in a stable manner over an extended period with no filming on the surface of a photosensitive material.

Another object of the present invention is to provide an electrophotographic developer which is of high transfer efficiency, enables images of high density and high quality to be obtained over an extended period, and makes solid black image tone variations unlikely to occur even in environments of high temperature and humidity.

SUMMARY OF THE INVENTION

Such objects are achievable by the inventions defined below as (1) to (9).

(1) A magnetic toner for electrophotography comprising a toner particle containing at least a binder resin and a magnetic powder, and an additive, wherein:

said additive comprises an ultrafine particle form of titanium oxide treated on a surface thereof with an aluminum compound of a fatty acid to make said surface hydrophobic, and a hydrophobic silica, and said ultrafine particle form of titanium oxide has a specific surface area of 80 to 120 $m^2/g$, a degree of hydrophobicity of 50 to 80% by weight, and an alumina content of 0.4 to 1.1% by weight.

(2) The magnetic toner of claim 1, wherein a fatty acid moiety of said aluminum compound of a fatty acid has 15 to 20 carbon atoms.

(3) The magnetic toner of claim 1, wherein said ultrafine particle form of titanium oxide is added to said magnetic toner in an amount of less than 1% by weight.

(4) The magnetic toner of claim 1, which has an average particle diameter of 5 to 12 $\mu$m.

(5) An electrophotographic developer obtained by mixing a magnetic toner particle containing at least a binder resin and a magnetic powder with a carrier particle, wherein:

said magnetic toner particle comprises an ultrafine particle form of titanium oxide treated on a surface thereof with an aluminum compound of a fatty acid to make said surface hydrophobic, and a hydrophobic silica, said ultrafine particle form of titanium oxide has a specific surface area of 80 to 120 $m^2/g$, a degree of hydrophobicity of 50 to 80% by weight, and an alumina content of 0.4 to 1.1% by weight, and 10 to 40 parts by weight of said carrier particle are mixed with 100 parts by weight of said magnetic toner particle.

(6) The developer of claim 5, wherein a fatty acid moiety of said aluminum compound of a fatty acid has 15 to 20 carbon atoms.

(7) The developer of claim 5, wherein an amount of said ultrafine particle form of titanium oxide added onto said magnetic toner particle is less than 1% by weight.

(8) The developer of claim 5, wherein said magnetic toner has an average particle diameter of 5 to 12 $\mu$m.

(9) The developer of claim 5, wherein said carrier particle has an average particle diameter of 10 to 100 $\mu$m.

It is noted that JP-A 4-452 discloses a toner containing titanium oxide treated with metal salts of fatty acids. However, the toner disclosed therein is a non-magnetic toner. Unlike the present disclosure, the publication says nothing about the degree of hydrophobicity, and the alumina content as well.

PREFERRED EMBODIMENTS OF THE INVENTION

Preferred embodiments of the present invention will now be explained.

The electrophotographic magnetic toner of the present invention comprises a toner particle containing a binder resin and a magnetic powder, and additives added externally onto the toner particle. In the present disclosure, such additives will hereinafter be called external additives. In the practice of the present invention, an ultrafine particle form of titanium oxide treated on its surface with an aluminum compound of a fatty acid (hereinafter called the fatty acid aluminum) to make the surface hydrophobic, and a hydrophobic silica are used for the external additives. The ultrafine particle form of titanium oxide used in this case has a specific surface area of 80 to 120 $m^2/g$, a degree of hydrophobicity of 50 to 80% by weight, and an alumina content of 0.4 to 1.1% by weight.

By use of such external additives it is possible to obtain images of high density and high quality over an extended period of time and even in environments of high temperature and humidity, with no filming found on the surface of a photosensitive material. The ultrafine titanium oxide particles, when having a specific surface area exceeding 120 $m^2/g$, are susceptible to agglomeration, resulting in cleaning or filming defects, which may otherwise cause an image quality drop. When the ultrafine titanium oxide particles have a specific surface area of less than 80 $m^2/g$, on the other hand, their fluidity become worse and so their ability to carry toner particles becomes worse. This in turn causes an image quality drop.

Ultrafine titanium oxide particles having a degree of hydrophobicity of less than 50% by weight fail to consistently keep the developing properties of the toner in various environments. In particular, density drops are often found in environments of high temperature and humidity. Ultrafine titanium oxide particles having a degree of hydrophobicity exceeding 80% by weight cause the stability of charges to become worse, and so cause the toner to be charged up at low humidity in particular. For this reason image quality drops are often observed upon continuous printing.

When the alumina content of the ultrafine titanium oxide particles is less than 0.4% by weight, there is a decrease in the amount of the fatty acid adsorbed onto their surfaces. In addition, the fatty acid is adsorbed in the form of double layers onto the surfaces of the ultrafine titanium oxide particles which, in this case, are susceptible to coagulation at the time of drying, yielding a coarse particle. For this reason image quality drops are found at high temperature and humidity. At an alumina content exceeding 1.1% by weight, ultrafine titanium oxide powders are susceptible to agglomeration. For this reason the toner cannot stand up to continuous printing.

By the "specific surface area" used herein is intended a BET specific surface area which is determined by the constant pressure method using a dedicated area meter (made by Streirhine, Germany).

The alumina content is determined by the constant volume method using a fluorescence X-ray device.

The degree of hydrophobicity is determined as mentioned just below.

Ten (10) ml of a methanol solution having a predetermined concentration (% by weight) is placed in a ground stopper test tube of 25 ml in volume. A small amount (ca. 10 mg) of ultrafine titanium oxide particles is charged in the methanol solution to ascertain whether or not they settle down. Whether or not the particles settle down is determined for each 2.5% by weight of methanol solution. The degree of hydrophobicity is expressed in terms of the % by weight of methanol solution at which no settlement is found and the % by weight of methanol solution at which settlement is found.

With the addition of the hydrophobic silica alone, the ability of the magnetic toner to be negatively charged tends to increase at low temperature and humidity to such an extent that excessive charges gives rise to fogs. In addition, image quality drops are observed at high temperature and humidity. With the addition of the ultrafine particle form of titanium oxide alone, on the other hand, the magnetic toner fails to have sufficient fluidity, resulting in an image density drop, and an image quality drop as well.

Referring further to the external additives used in the present invention, the ultrafine titanium oxide particles made hydrophobic by the surface treatment with the fatty acid aluminum have a specific surface area of 80 to 120 $m^2/g$, a degree of hydrophobicity of 50 to 80% by weight, and an alumina content of 0.4 to 1.1% by weight.

Although the titanium oxide subjected to the surface treatment with the fatty acid aluminum is usually anatase obtained by the sulfuric acid method, it is understood that use may also be made of rutile. The primary particles of the titanium oxide have an average particle diameter of about 10 to 30 nm, and have an average particle diameter of at most about 20 to 40 nm even after the surface treatment.

The surface treatment process may be carried out as mentioned just below. The raw material, usually hydrous titanium oxide is dispersed, regulated, washed, dried, and fired. Following this, the fired titanium oxide is dispersed, pulverized, and classified. A given amount of the fatty acid aluminum is added to the thus classified titanium oxide, which is further treated, washed, dried, and subjected to given heat and pulverization treatments, whereby the aforesaid hydrophobic ultrafine titanium oxide particles are obtained.

No particular limitation is imposed on the fatty acid aluminum used in this case; use may be made of such aluminum compounds of fatty acids as set out just below. Exemplary fatty acids include saturated fatty acids such as formic acid, acetic acid, propionic acid, butyric acid, valeric acid, caproic acid, enanthic acid, caprylic acid, pelargonic acid, capric acid, undecylic acid, lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid, and lacceric acid, and unsaturated fatty acids such as acrylic acid, crotonic acid, isocrotonic acid, undecylenic acid, oleic acid, elaidic acid, cetoleic acid, erucic acid, brassidic acid, sorbic acid, linoleic acid, linolenic acid, arachidonic acid, propiolic acid, and stearolic acid.

Preferred among these are fatty acids, especially unsaturated fatty acids, having 15 to 20 carbon atoms, and specifically pentadecylic acid, palmitic acid, heptadecylic acid, stearic acid, nonadecanoic acid and arachic acid, with stearic acid being practically most preferred.

The amount of the ultrafine titanium oxide particles made hydrophobic by the surface treatment with the fatty acid aluminum is preferably less than 1% by weight, particularly 0.05 to 0.9% by weight, and more particularly 0.1 to 0.8% by weight with respect to the magnetic toner. By use of the ultrafine titanium oxide particles in such an amount, it is possible to make more effective use of the advantages of the present invention. However, too much makes the electric conductivity of the toner too high or makes the ability of the toner to be charged too low to cause a density drop.

As another external additive, every known hydrophobic silica material may be used together with the ultrafine titanium oxide made hydrophobic by the surface treatment with the fatty acid aluminum. If necessary, the hydrophobic silica may be treated on its surface with various agents such as coupling agents, and silicone oil.

The hydrophobic silica used has preferably an average particle diameter of 5 to 20 nm. In this regard, it is noted that when the hydrophobic silica is in an aspheric form, the particle diameter can be found by calculating its projection area as a circle.

The amount of the hydrophobic silica added onto the magnetic toner is preferably 0.1 to 5% by weight, and more particularly 0.3 to 2.0% by weight. By use of the hydrophobic silica in such an amount, it is possible to make more effective use of the advantages of the present invention. Too much causes the ability of the magnetic toner to be negatively charged to become excessively large at low temperature and humidity, resulting in a likelihood of fogs occurring. Too little, on the other hand, makes it difficult to impart sufficient fluidity to the magnetic toner.

The magnetic toner of the present invention is made up of the toner particle onto which such external additives as mentioned above are added, and the toner particle according to the present invention contains at least a binder resin and a magnetic powder as internal additives. Every resin used for conventional toners may be used as the binder resin; however, particular preference is given to styrene base copolymer resins. The styrene base copolymer resins are obtained by copolymerization reactions between styrene base monomers and vinylic monomers copolymerizable therewith.

Exemplary copolymerizable monomers in this case are styrene and its derivative, acrylic, and methacrylic esters such as methyl acrylate, ethyl acrylate, isopropyl acrylate, n-butyl acrylate, α-ethylhexyl acrylate, α-hydroxyethyl acrylate, hydroxypropyl acrylate, methyl methacrylate, ethyl methacrylate, isopropyl methacrylate, n-butyl methacrylate, isobutyl methacrylate, n-hexyl methacrylate, lauryl methacrylate, α-hydroxyethyl methacrylate, and hydroxypropyl methacrylate, vinyl esters, ethylenic olefins, and ethylenic unsaturated carboxylates.

Besides, polyester resins may be used. The polyester resins are obtained by polycondensation reactions between polybasic acid components and polyhydric alcohol components.

Exemplary polybasic acids in this case are aliphatic, and alicyclic polycarboxylic acids represented by oxalic acid, malonic acid, succinic acid, glutaric acid, adipic acid, pimelic acid, suberic acid, azelaic acid, sebacic acid, maleic acid, fumaric acid, phthalic acid, isophthalic acid, terephthalic acid, 1,4-cyclohexanedicarboxylic acid, and 1,3-cyclohexanedicarboxylic acid, and their anhydrides.

Exemplary polyhydric alcohols are aliphatic, aromatic, and alicyclic polyalcohols represented by ethylene glycol, propylene glycol, trimethylene glycol, 1,4-butanediol, 1,5-pentanediol, 1,6-hexanediol, 1,7-heptanediol, 1,8-octanediol, 1,9-nonanediol, 1,10-decanediol, pinacol, hydrobenzoin, benzpinacol, cyclopentane-1,2-diol, cyclohexane-1,2-diol, and cyclohexane-1,4-diol.

Some other resins may be used, including epoxy resins, silicone resins, fluorocarbon resins, polyamide resins, acrylic resins, polyurethane resins, polyether resins, polyvinyl alcohol resins, polyethylene, ethylene-vinyl acetate copolymers, polypropylene, and the like.

These resins may be used alone or in admixtures of two or more if required.

These resins may be prepared by known polymerization processes such as solution polymerization, suspension polymerization, emulsion polymerization, bulk polymerization, heat polymerization, catalytic polymerization, high-pressure polymerization, and low-pressure polymerization, and suitable combinations thereof.

The magnetic powders used herein, on the other hand, include powders of every known magnetic material, for instance, powders of metals such as iron, manganese, cobalt, nickel, and chromium, or alloys thereof, powders of metal oxides such as chromium oxide, diiron trioxide, and triiron tetraoxide, and powders of ferrites represented by a general formula $MO.Fe_2O_3$ where M is at least one metal selected from the group consisting of monovalent or divalent metals such as Fe, Mn, Co, Ni, Mg, Zn, Cd, Ba, and Li.

The magnetic powders have preferably an average particle diameter of 0.01 to 10 μm, particularly 0.05 to 3 μm. The smaller the average particle diameter, the readier the magnetic toner particle are to run away because of a drop of their magnetic force. As the average particle diameter becomes large, on the other hand, the image density tends to drop, and so the image quality tends to deteriorate.

In this case, the average particle diameter is determined by the following method. First, specific surface area (BET one point method) Sw is measured by the one point method for BET method using a Micromeritex Flowsoap 2300 Model made by Shimadzu Kagaku Kiki. Given the relation of particle diameter to specific surface area, the average particle diameter D is then found by $$Sw=[\Sigma ni4\pi(Di/2)^2]/[\Sigma ni\rho(4/3)\pi\cdot(Di/2)^3]=6/\rho\cdot D$$

where Sw is a specific surface area, Di is a particle diameter, ni is the number of particles, ρ is the density of powders, and $D=6/\rho\cdot Sw$.

Preferably, the magnetic powder content of the magnetic toner particles is 20 to 70% by weight, particularly 30 to 60% by weight. A decrease in the magnetic powder content causes a decrease of the magnetic force of the magnetic toner particles. This in turn gives rise to image defects such as resolution drops, and increased fogs. As the magnetic powder content increases, on the other hand, the ability of the toner to be charged tends to decrease. This in turn causes the abilities of the toner to be charged and fixed to become worse, resulting in an image density drop.

Preferably in the present invention, the average particle diameter of the magnetic toner is 5 to 12 μm. As the average particle diameter becomes large, the resolution of the magnetic toner becomes too worse to obtain high-quality images. As the average particle diameter becomes small, on the other hand, the fluidity of the magnetic toner becomes worse. This in turn makes the agglomeration of the magnetic toner likely to occur, resulting in an image quality drop.

The average particle diameter of the magnetic toner is measured by the Coulter counter method wherein volume particle diameters of measurements are calculated so that the 50% average particle diameter thereof can be defined as the average particle diameter. In the Coulter counter method, measurements are obtained on volume basis, using isotone II (made by Coulter Electronics Co., Ltd.) as an electrolyte, and Coulter Counter TA-II having an aperture diameter of 100 μm (again made by Coulter Electronics Co., Ltd.), for instance.

If necessary, the magnetic toner particle for developers according to the present invention may contain a charge control agent, and other additives in the form of internal additives. The charge control agent may be added to the magnetic toner particles, if required, to control the polarity, amount, etc. of charges. In the practice of the present invention, no particular limitation is placed on the charge control agent; that is, a choice may be made from known charge control agents depending on the end polarity and amount of charges. For instance, use may be made of metal complex salts of azo base dyes, and Nigrosine base dyes, from which a choice may be made depending on the properties needed for the magnetic toner particles. Preferably, the magnetic toner particles contain about 0.05 to 10 parts by weight of such a charge control agent.

The magnetic toner particles of the present invention may also contain 0.1 to 10 parts by weight of carbon black as a color-regulating pigment.

Other additives added internally into the toner particles include waxes, olefins such as polyethylene and polypropylene or silicone oil. The waxes are added into the toner particles as an offset-preventing release agent, if required. In the practice of the present invention, no particular limitation is imposed on the waxes used; that is, use may be made of various known waxes, for instance, polyethylene wax, polypropylene wax, and silicone wax, from which a choice may be made depending on the properties needed for the toner particles. Preferably, the content of these waxes in the toner particles is 0.5 to 20 parts by weight.

The electrophotographic magnetic toner according to the present invention may be fabricated by adding the external additives onto a toner particle containing the internal additives, and mixing them together by means of a high speed mixer such as a Henschel mixer or V-type blender.

The electrophotographic developer according to the present invention comprises a toner particle and a carrier particle.

The magnetic toner particle according to the present invention contains a binder resin and a magnetic powder, with external additives added onto it. The external additives used in the present invention are a ultrafine particle form of titanium oxide made hydrophobic on its surface by treatment with the fatty acid aluminum, and a hydrophobic silica. In this case, the ultrafine particle form of titanium oxide has a specific surface area of 80 to 120 $m^2/g$, a degree of hydrophobicity of 50 to 80% by weight, and an alumina content of 0.4 to 1.1% by weight. Ten to forty (10 to 40) parts by weight of the carrier particle are mixed with 100 parts by weight of the magnetic toner particle.

By using the external additives and limiting the mixing ratio of the magnetic toner particle and the carrier particle to the aforesaid range, it is possible to achieve satisfactory transferability, obtain high-density and high-quality images over an extended period of time, and reduce solid black image tone variations at high temperature and humidity. Ultrafine titanium oxide particles, when having a specific surface area exceeding 120 $m^2/g$, are susceptible to agglomeration, which may in turn cause drops of transferability and image quality, and filming as well.

When ultrafine titanium oxide particles have a specific surface area of less than 80 $m^2/g$, their fluidity becomes worse, and so their ability to carry magnetic toner particles becomes worse, resulting in a likelihood of solid black image tone variations occurring.

Ultrafine titanium oxide particles having a degree of hydrophobicity of less than 50% by weight fail to consistently keep the developing properties of the magnetic toner in various environments. In particular, density drops are often found in environments of high temperature and humidity. Ultrafine titanium oxide particles having a degree of hydrophobicity exceeding 80% by weight cause charge stability to become worse, and so cause magnetic toner particles to be charged up at low humidity in particular. For this reason transfer efficiency drops are often observed.

When the alumina content of the ultrafine titanium oxide particles is less than 0.4% by weight, there is a decrease in the amount of the fatty acid adsorbed onto their surfaces. In addition, the fatty acid is adsorbed in the form of double layers onto the surfaces of the ultrafine titanium oxide particles which, in this case, are susceptible to coagulation at the time of drying, yielding a coarse particle. For this reason transfer efficiency drops are observed with image quality drops, and solid black image tone variations.

By the "specific surface area" used herein is intended a BET specific surface area which is determined by the constant pressure method using a dedicated area meter (made by Streirhine, Germany).

The alumina content is determined by the constant volume method using a fluorescence X-ray device.

The degree of hydrophobicity is determined as mentioned just below. Ten (10) ml of a methanol solution having a predetermined concentration (% by weight) is placed in a ground stopper test tube of 25 ml in volume. A small amount (ca. 10 mg) of ultrafine titanium oxide particles is charged in the methanol solution to ascertain whether or not they settle down. Whether or not the particles settle down is determined for each 2.5% by weight of methanol solution. The degree of hydrophobicity is expressed in terms of the % by weight of methanol solution at which no settlement is found and the % by weight of methanol solution at which settlement is found.

With the addition of the hydrophobic silica alone, the ability of magnetic toner particles to be negatively charged tends to increase at low temperature and humidity to such an extent that excessive charges gives rise to fogs. In addition, image quality drops, and solid black image tone variations are observed at high temperature and humidity. With the addition of the ultrafine particle form of titanium oxide alone, on the other hand, magnetic toner particles fail to have sufficient fluidity, resulting in solid black image tone variations, and image quality drops as well.

When the amount of the carrier particles exceeds 40 part by weight per 100 parts by weight of the magnetic toner particles, image densities, fogs, and the stability of resolution become worse at the time of continuous printing. At less than 10 parts by weight, the magnetic toner particles are susceptible to agglomeration, which may otherwise result in white streaks. Furthermore, image quality drops are observed at the time of continuous printing, and solid black image tone variations are found at high temperature and humidity.

Referring further to the external additives used in the present invention, the ultrafine titanium oxide particles made hydrophobic by the surface treatment with the fatty acid aluminum have a specific surface area of 80 to 120 $m^2/g$, a degree of hydrophobicity of 50 to 80% by weight, and an alumina content of 0.4 to 1.1% by weight.

Although the titanium oxide subjected to the surface treatment with the fatty acid aluminum is usually anatase obtained by the sulfuric acid method, it is understood that use may also be made of rutile. The primary particles of the titanium oxide have an average particle diameter of about 10 to 30 nm, and have an average particle diameter of at most about 20 to 40 nm even after the surface treatment.

The surface treatment process may be carried out as mentioned just below. The raw material, usually hydrous titanium oxide is dispersed, regulated, washed, dried, and fired. Following this, the fired titanium oxide is dispersed, pulverized, and classified. A given amount of the fatty acid aluminum is added to the thus classified titanium oxide, which is further treated, washed, dried, and subjected to given heat and pulverization treatments, whereby the aforesaid hydrophobic ultrafine titanium oxide particles are obtained.

No particular limitation is imposed on the fatty acid aluminum used in this case; use may be made of such aluminum compounds of fatty acids as set out just below. Exemplary fatty acids include saturated fatty acids such as formic acid, acetic acid, propionic acid, butyric acid, valeric acid, caproic acid, enanthic acid, caprylic acid, pelargonic acid, capric acid, undecylic acid, lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid, and lacceric acid, and unsaturated fatty acids such as acrylic acid, crotonic acid, isocrotonic acid, undecylenic acid, oleic acid, elaidic acid, cetoleic acid, erucic acid, brassidic acid, sorbic acid, linoleic acid, linolenic acid, arachidonic acid, propiolic acid, and stearolic acid.

Preferred among these are fatty acids, in particular unsaturated fatty acids, having 15 to 20 carbon atoms, and specifically pentadecylic acid, palmitic acid, heptadecylic acid, stearic acid, nonadecanoic acid and arachic acid, with stearic acid being practically most preferred.

The amount of the ultrafine titanium oxide particles made hydrophobic by the surface treatment with the fatty acid aluminum is preferably less than 1% by weight, particularly 0.05 to 0.9% by weight, and more particularly 0.1 to 0.8% by weight with respect to the magnetic toner. By use of the ultrafine titanium oxide particles in such an amount, it is possible to make more effective use of the advantages of the present invention. However, too much makes the electric conductivity of the toner too high or makes the ability of the toner to be charged too low to cause a density drop.

As another external additive, every known hydrophobic silica material may be used together with the ultrafine titanium oxide particles made hydrophobic by the surface treatment with the fatty acid aluminum. If necessary, the hydrophobic silica may be treated on its surface with various agents such as coupling agents, and silicone oil.

The hydrophobic silica used has preferably an average particle diameter of 5 to 20 nm. In this regard, it is noted that when the hydrophobic silica is in an aspheric form, the particle diameter can be found by calculating its projection area as a circle.

The amount of the hydrophobic silica added onto the magnetic toner particles is preferably 0.1 to 5% by weight, and more particularly 0.3 to 2.0% by weight. By use of the hydrophobic silica in such an amount, it is possible to make more effective use of the advantages of the present invention. Too much causes the ability of the magnetic toner particles to be negatively charged to become excessively large at low temperature and humidity, resulting in a likelihood of fogs occurring. Too little, on the other hand, makes it difficult to impart sufficient fluidity to the magnetic toner.

The magnetic toner particles for electrophotographic developers according to the present invention may further contain magnetic particles as an external additive, in addition to the hydrophobic silica and the ultrafine particle form of titanium oxide.

The amount of the magnetic powders added onto the magnetic toner particles is limited to about 0.1 to 10% by weight, whereby fogs can be substantially eliminated irrespective of the presence or absence of developing biases to obtain good-enough image qualities.

The magnetic toner particle of the present invention contains at least a binder resin and a magnetic powder as internal additives. All resins used for conventional toners may be used as the binder resin; however, particular preference is given to styrene base copolymer resins. The styrene base copolymer resins are obtained by copolymerization reactions between styrene base monomers and vinylic monomers copolymerizable therewith.

Exemplary copolymerizable monomers in this case are styrene and its derivative, acrylic, and methacrylic esters such as methyl acrylate, ethyl acrylate, isopropyl acrylate, n-butyl acrylate, α-ethylhexyl acrylate, α-hydroxyethyl acrylate, hydroxypropyl acrylate, methyl methacrylate, ethyl methacrylate, isopropyl methacrylate, n-butyl methacrylate, isobutyl methacrylate, n-hexyl methacrylate, lauryl methacrylate, α-hydroxyethyl methacrylate, and hydroxypropyl methacrylate, vinyl esters, ethylenic olefins, and ethylenic unsaturated carboxylates.

Besides, polyester resins may be used. The polyester resins are obtained by polycondensation reactions between polybasic acid components and polyhydric alcohol components.

Exemplary polybasic acids in this case are aliphatic, and alicyclic polycarboxylic acids represented by oxalic acid, malonic acid, succinic acid, glutaric acid, adipic acid, pimelic acid, suberic acid, azelaic acid, sebacic acid, maleic acid, fumaric acid, phthalic acid, isophthalic acid, terephthalic acid, 1,4-cyclohexanedicarboxylic acid, and 1,3-cyclohexanedicarboxylic acid, and their anhydrides.

Exemplary polyhydric alcohols are aliphatic, aromatic, and alicyclic polyalcohols represented by ethylene glycol, propylene glycol, trimethylene glycol, 1,4-butanediol, 1,5-pentanediol, 1,6-hexanediol, 1,7-heptanediol, 1,8-octanediol, 1,9-nonanediol, 1,10-decanediol, pinacol, hydrobenzoin, benzpinacol, cyclopentane-1,2-diol, cyclohexane-1,2-diol, and cyclohexane-1,4-diol.

Some other resins may be used, including epoxy resins, silicone resins, fluorocarbon resins, polyamide resins, acrylic resins, polyurethane resins, polyether resins, polyvinyl alcohol resins, polyethylene, ethylene-vinyl acetate copolymers, polypropylene, and the like.

These resins may be used alone or in admixtures of two or more if required.

These resins may be prepared by known polymerization processes such as solution polymerization, suspension polymerization, emulsion polymerization, bulk polymerization, heat polymerization, catalytic polymerization, high-pressure polymerization, and low-pressure polymerization, and suitable combinations thereof.

The magnetic powders used herein, on the other hand, include powders of every known magnetic material, for instance, powders of metals such as iron, manganese, cobalt, nickel, and chromium, or alloys thereof, powders of metal oxides such as chromium oxide, diiron trioxide, and triiron tetraoxide, and powders of ferrites represented by a general formula $MO.Fe_2O_3$ where M is at least one metal selected from the group consisting of monovalent or divalent metals such as Fe, Mn, Co, Ni, Mg, Zn, Cd, Ba, and Li.

The magnetic powders have preferably an average particle diameter of 0.01 to 10 μm, particularly 0.05 to 3 μm. The smaller the average particle diameter, the readier the magnetic toner particles are to run away because of a drop of their magnetic force. As the average particle diameter becomes large, on the other hand, the image density tends to drop, and so the image quality tends to deteriorate.

In this case, the average particle diameter is determined by the following method. First, specific surface area (BET one point method) Sw is measured by the one point method for BET method using a Micromeritex Flowsoap 2300 Model made by Shimadzu Kagaku Kiki. Given the relation of particle diameter to specific surface area, the average particle diameter D is then found by $$Sw=[\Sigma ni4\pi(Di/2)^2]/[ni\rho(4/3)\pi\cdot(Di/2)^3]=6/\rho\cdot D$$

where Sw is a specific surface area, Di is a particle diameter, ni is the number of particles, ρ is the density of powders, and $D=6/\rho\cdot Sw$.

Preferably, the magnetic powder content of the magnetic toner particles is 20 to 70% by weight, particularly 30 to 60% by weight. A decrease in the magnetic powder content causes a decrease of the magnetic force of the magnetic toner particles. This in turn gives rise to image defects such as resolution drops, and increased fogs. As the magnetic powder content increases, on the other hand, the ability of the toner to be charged tends to decrease. This in turn causes the abilities of the toner to be charged and fixed to become worse, resulting in an image density drop.

Preferably in the present invention, the average particle diameter of the magnetic toner is 5 to 12 μm. As the average particle diameter becomes large, the resolution of the magnetic toner becomes too worse to obtain high-quality images. As the average particle diameter becomes small, on the other hand, the fluidity of the magnetic toner becomes worse. This in turn makes the agglomeration of the magnetic toner likely to occur, resulting in an image quality drop.

The average particle diameter of the magnetic toner particles is measured by the Coulter counter method wherein volume particle diameters of measurements are calculated so that the 50% average particle diameter thereof can be defined as the average particle diameter. In the Coulter counter method, measurements are obtained on volume basis, using isotone II (made by Coulter Electronics Co., Ltd.) as an electrolyte, and Coulter Counter TA-II having an aperture diameter of 100 μm (again made by Coulter Electronics Co., Ltd.), for instance.

If necessary, the magnetic toner particle for developers according to the present invention may contain a charge control agent, and other additives in the form of internal additives. The charge control agent may be added into the magnetic toner particles, if required, to control the polarity, amount, etc. of charges. In the practice of the present invention, it is preferable to use as the charge control agent a low-molecular-weight polymer having a weight-average molecular weight of 1,000 to 20,000, as disclosed in JP-A 3-256053. The amount of the charge control agent in the magnetic toner particles is preferably about 0.05 to 10 parts by weight.

Preferably, the magnetic toner particles for electrophotographic developers according to the present invention are free from an azo type dye metal complex salt or a Nigrosine type dye. When the azo type dye metal complex salt or the Nigrosine type dye is used as the charge control agent, and especially when a developer is enriched with a toner by increasing an initial toner content thereof, such defects as toner scattering, an increased fogging of non-image areas, a toner density drop, and toner spent are likely to occur. Azo type dye metal complex salts or Nigrosine type dyes, which should not be internally added into toners, are set forth in JP-A 2-72373, etc.

The magnetic toner particles of the present invention may also contain 0.1 to 10 parts by weight of carbon black as a color-regulating pigment.

Other additives added internally into the toner particles include waxes, olefins such as polyethylene and polypropylene or silicone oil. The waxes are added into the toner particles as an offset-preventing release agent, if required. In the practice of the present invention, no particular limitation is imposed on the waxes used; that is, use may be made of various known waxes, for instance, polyethylene wax, polypropylene wax, and silicone wax, from which a choice may be made depending on the properties needed for the toner particles. Preferably, the content of these waxes in the toner particles is 0.5 to 20 parts by weight.

The electrophotographic magnetic toner particle according to the present invention may be fabricated by adding the external additives onto a toner particle containing the internal additives, and mixing them together by means of a high speed mixer such as a Henschel mixer or V-type blender.

The electrophotographic developer according to the present invention comprises a mixture of carrier particles with magnetic toner particles. The carrier material used herein is not critical, and so may be selected from various soft magnetic materials such as iron, magnetite, and various ferrites.

For the ferrites in this case, use may be made of all ferrites having known compositions, for instance, Mg—Cu—Zn ferrite, Ni—Zn ferrite, and Cu—Zn ferrite.

Such carrier particles, if required, may have a skin formed of acrylic resin, silicone resin, fluorocarbon resin or the like or may contain a binder such as polyester resin or styrene-acrylic resin, as is the case with the aforesaid toner particles.

The carrier particles contained in the developer of the present invention have an average particle diameter of preferably 10 to 100 $\mu$m, and more preferably 20 to 80 $\mu$m. As the average particle diameter increases, resolution becomes worse, and the developing unit used is susceptible to contamination due to toner scattering. As the average particle diameter decreases, on the other hand, more carrier is likely to be dragged out.

The average particle diameter used herein is a 50% particle diameter determined upon calculation of volume average particle diameter from measurements by the micro-track method. It may be calculated from the data obtained by dispersing a sample in water with the aid of a dispersant and taking measurements on volume basis using a micro-track type STD 7991-0 (Leeds & Northrup Co.).

In the developer according to the present invention, 10 to 40 parts by weight of the carrier particles are mixed with 100 parts by weight of the magnetic toner particles, as already mentioned.

Mixing may be carried out using a Nauta mixer, a V-type blender or the like.

EXAMPLE

By way of illustration and not by way of limitation, the present invention will now be explained with reference to examples and comparative examples.

Set out in Table 1 are hydrophobic ultrafine particle forms of titanium oxide used in the following examples and comparative examples of magnetic toners.

TABLE 1

| Surface Treating Agent | Specific Surface Area ($m^2/g$) | Degree of Hydrophobicity (wt. %) | Alumina Content (wt. %) |
|---|---|---|---|
| A aluminum stearate | 106.9 | 60.0 | 0.90 |
| B aluminum stearate | 85.6 | 72.5 | 1.03 |
| C aluminum stearate | 113.1 | 52.5 | 0.52 |
| D* aluminum stearate | 130.5* | 57.5 | 0.73 |
| E* aluminum stearate | 71.2* | 60.0 | 0.86 |
| F* aluminum stearate | 109.9 | 42.5* | 0.49 |
| G* aluminum stearate | 93.2 | 85.0* | 1.05 |
| H* aluminum stearate | 101.4 | 52.5 | 0.31* |
| I* aluminum stearate | 102.7 | 57.5 | 1.29* |
| J* cyclic silicone oil* | 95.0 | 52.5 | 0.80 |
| K* aminosilane* | 98.0 | 52.5 | 0.81 |

The asterisks mean deviations from the scope of the present invention.

Example 1

A toner composition, mentioned below, was fully mixed in a Henschel mixer, milled in a heat melting mill, cooled down, and crushed in a hammer mill. The mixture was then finely divided in a jet impact mill, after which an excessive fine fraction was removed by an air classifier. Using a Henschel mixer, external additives, mentioned below, were added onto and mixed with the remaining particles.

Following this, an excessive coarse fraction was removed by an air classifier, thereby obtaining magnetic toner particles having a given particle diameter distribution. This toner had an average particle diameter of 9 $\mu$m. The abbreviation "pbw" used hereinafter is part by weight.

| Toner Composition: | |
|---|---|
| Magnetic powder | 65 pbw |
| Styrene-butyl acrylate resin | 100 pbw |
| Polypropylene wax | 4 pbw |
| Charge control agent (Cr complex of azo type dye) | 0.5 pbw |
| External additives per 100 pbw of toner composition: | |
| Hydrophobic silica | 1.0 pbw |
| Hydrophobic ultrafine particle form of titanium oxide A | 0.3 pbw |

Example 2

A magnetic toner was prepared following Example 1 with the exception that the external additive was changed from hydrophobic ulfrafine particle form of titanium oxide A to B. This magnetic toner had an average particle diameter of 9 $\mu$m.

Example 3

A magnetic toner was prepared following Example 1 with the exception that the external additive was changed from hydrophobic ulfrafine particle form of titanium oxide A to C. This magnetic toner had an average particle diameter of 9 μm.

Comparative Example 1

A magnetic toner was prepared following Example 1 with the exception that only hydrophobic silica was used as the external additive. This magnetic toner had an average particle diameter of 9 μm.

Comparative Example 2

A magnetic toner was prepared following Example 1 with the exception that the external additive was changed from hydrophobic ulfrafine particle form of titanium oxide A to D. This magnetic toner had an average particle diameter of 9 μm.

Comparative Example 3

A magnetic toner was prepared following Example 1 with the exception that the external additive was changed from hydrophobic ulfrafine particle form of titanium oxide A to E. This magnetic toner had an average particle diameter of 9 μm.

Comparative Example 4

A magnetic toner was prepared following Example 1 with the exception that the external additive was changed from hydrophobic ulfrafine particle form of titanium oxide A to F. This magnetic toner had an average particle diameter of 9 μm.

Comparative Example 5

A magnetic toner was prepared following Example 1 with the exception that the external additive was changed from hydrophobic ulfrafine particle form of titanium oxide A to G. This magnetic toner had an average particle diameter of 9 μm.

Comparative Example 6

A magnetic toner was prepared following Example 1 with the exception that the external additive was changed from hydrophobic ulfrafine particle form of titanium oxide A to H. This magnetic toner had an average particle diameter of 9 μm.

Comparative Example 7

A magnetic toner was prepared following Example 1 with the exception that the external additive was changed from hydrophobic ulfrafine particle form of titanium oxide A to I. This magnetic toner had an average particle diameter of 9 μm.

Comparative Example 8

A magnetic toner was prepared following Example 1 with the exception that the external additive was changed from hydrophobic ulfrafine particle form of titanium oxide A to J. This magnetic toner had an average particle diameter of 9 μm.

Comparative Example 9

A magnetic toner was prepared following Example 1 with the exception that the external additive was changed from hydrophobic ulfrafine particle form of titanium oxide A to K. This magnetic toner had an average particle diameter of 9 μm.

Comparative Example 10

A magnetic toner was prepared following Example 1 with the exception that 0.5 parts by weight of hydrophobic ultrafine particle form of titanium oxide A alone were used as the external additive. This magnetic toner had an average particle diameter of 9 μm.

Example 4

A magnetic toner was prepared following Example 1 with the exception that the amount of the external additive, hydrophobic ultrafine particle form of titanium oxide A, was changed from 0.3 parts by weight to 1.2 parts by weight. This magnetic toner had an average particle diameter of 9 μm.

Printing Test

Using a commercially available laser beam printer (8 sheets per minute) together with each of the magnetic toners obtained as mentioned above, 5,000 sheets were printed to make estimation of image density and image quality at the end of 1st, and 5,000th printing, at normal temperature and humidity (20° C. and 60% RH), and at high temperature and humidity (32.5° C. and 80% RH), respectively. Filming on the photosensitive material, too, was estimated at normal temperature and humidity.

Set out below are measuring, and estimating procedures.

The image density was measured and estimated using a reflection densitometer (Macbeth Co., Ltd.).

The filming on the photosensitive material was evaluated by visual observation of the surface of the photosensitive material after the 5,000th printing.

The image quality inclusive of fogging of non-image areas, toner scattering, breaks in printed characters, and resolution was evaluated in terms of five ratings or double circle, circle, triangle, black triangle, and cross marks, with the double circle mark showing "excellent" and the cross "inferior". It is noted that the triangle mark shows that the sample is on a practically acceptable level.

The results are reported in Table 2 wherein "–" shows that the sample could not be estimated because of damage to the photosensitive material by reason of filming.

TABLE 2

| | | Ti Oxide | Silica | Normal temperature and humidity 1st | | 5,000th | | Filming on photosensitive | High temperature and humidity 1st | |
|---|---|---|---|---|---|---|---|---|---|---|
| | | pbw | pbw | Density | Quality | Density | Quality | material | Density | Quality |
| Ex. | 1 | A(0.3) | 1.0 | 1.46 | ◎ | 1.45 | ◎ | No filming | 1.38 | ○ |
| | 2 | B(0.3) | 1.0 | 1.45 | ◎ | 1.43 | ○ | No filming | 1.40 | ○ |
| | 3 | C(0.3) | 1.0 | 1.45 | ◎ | 1.45 | ◎ | No filming | 1.37 | ○ |
| Comp. Ex. | 1** | — | 1.0 | 1.47 | ○ | 1.36 | ▲ | No filming | 1.35 | ▲ |
| | 2 | D(0.3) | 1.0 | 1.47 | ◎ | — | — | Filming found | 1.37 | ○ |
| | 3 | E(0.3) | 1.0 | 1.43 | ○ | 1.34 | ▲ | No filming | 1.33 | ▲ |
| | 4 | F(0.3) | 1.0 | 1.44 | ○ | 1.42 | ○ | No filming | 1.18 | X |
| | 5 | G(0.3) | 1.0 | 1.46 | ◎ | 1.30 | ▲ | No filming | 1.42 | ○ |
| | 6 | H(0.3) | 1.0 | 1.45 | ○ | 1.32 | Δ | No filming | 1.30 | ▲ |
| | 7 | I(0.3) | 1.0 | 1.43 | ○ | — | — | Filming found | 1.35 | Δ |
| | 8 | J(0.3) | 1.0 | 1.46 | ◎ | — | — | Filming found | 1.38 | ○ |
| | 9 | K(0.3) | 1.0 | 1.48 | ◎ | — | — | Filming found | 1.36 | ○ |
| | 10 | A(0.5) | — | 1.30 | ○ | 1.21 | ▲ | No filming | 1.20 | ▲ |
| Ex. | 4 | A(1.2) | 1.0 | 1.42 | ○ | 1.40 | Δ | No filming | 1.36 | ○ |

** Fogging was also found at low temperature and humidity (10° C. and 20% RH).

The effectiveness of the present invention is evident from Table 2. In this regard, it is noted that in the magnetic toner of comparative example 1 considerable fogging was observed at low temperature and humidity (10° C. and 20% RH).

Examples 1 to 3 were repeated with the exception that the fatty acid aluminum used in preparing the external additive for the magnetic toner particles, i.e., the hydrophobic ultrafine particle form of titanium oxide was changed from aluminum stearate to aluminum compounds of pentadecylic acid, palmitic acid, heptadecylic acid, and arachic acid, respectively. Satisfactory results equivalent to those of Examples 1 to 3 were obtained.

Set out in Table 3 are hydrophobic ultrafine particle forms of titanium oxide used in the following examples and comparative examples of developers containing magnetic toners and carriers.

TABLE 3

| Surface Treating Agent | Specific Surface Area ($m^2/g$) | Degree of Hydrophobicity (wt. %) | Alumina Content (wt. %) |
|---|---|---|---|
| A aluminum stearate | 106.9 | 60.0 | 0.90 |
| B aluminum stearate | 85.6 | 72.5 | 1.03 |
| C aluminum stearate | 113.1 | 52.5 | 0.52 |
| D* aluminum stearate | 130.5* | 57.5 | 0.73 |
| E* aluminum stearate | 71.2* | 60.0 | 0.86 |
| F* aluminum stearate | 109.9 | 42.5* | 0.49 |
| G* aluminum stearate | 93.2 | 85.0* | 1.05 |
| H* aluminum stearate | 101.4 | 52.5 | 0.31* |
| I* aluminum stearate | 102.7 | 57.5 | 1.29* |
| J* cyclic silicone oil* | 95.0 | 52.5 | 0.80 |
| K* aminosilane* | 98.0 | 52.5 | 0.81 |

The asterisks mean deviations from the scope of the present invention.

The carrier particles were prepared as mentioned below.

Preparation of the Carrier Particles

A composition $10.5Mg(OH)_2$—$7.5CuO$—$20ZnO$—$62Fe_2O_3$ (mol %) was placed in a mixer wherein it was mixed in a slurry state. The mixture was pulverized in an attritor. The powders were granulated and dried in a spray dryer, and sintered in an electric furnace. From the sintered mass, carrier particles 1 having an average particle diameter of 35 μm, carrier particles 2 having an average particle diameter of 50 μm, and carrier particles 3 having an average particle diameter of 70 μm were obtained.

These carrier particles were used to prepare electrophotographic developers.

Example 5

A toner composition, mentioned below, was fully mixed in a Henschel mixer, milled in a heat melting mill, cooled down, and crushed in a hammer mill. The mixture was then finely divided in a jet impact mill, after which an excessive fine fraction was removed by an air classifier. Using a Henschel mixer, external additives, mentioned below, were added onto the remaining particles.

Following this, an excessive coarse fraction was removed by an air classifier, thereby obtaining magnetic toner particles having a given particle diameter distribution. This magnetic toner particles had an average particle diameter of 10 μm.

One hundred (100) parts by weight of the obtained magnetic toner particles were mixed with 25 parts by weight of the carrier particles 2 having an average particle diameter of 50 μm to prepare a developer.

| Toner Composition: | |
|---|---|
| Magnetic powder | 62 pbw |
| Styrene-butyl acrylate resin | 100 pbw |

-continued

| | |
|---|---|
| Polypropylene wax | 5 pbw |
| Charge control agent | 1.5 pbw |
| External additives per 100 pbw of toner composition: | |
| Hydrophobic silica | 0.5 pbw |
| Hydrophobic ultrafine particle form of titanium oxide A | 0.1 pbw |
| Magnetic particle | 3.0 pbw |

Example 6

Magnetic toner particles were obtained following Example 5 with the exception that the external additive, i.e., the hydrophobic ultrafine particle form of titanium oxide was changed from A to B. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Example 7

Magnetic toner particles were obtained following Example 5 with the exception that the external additive, i.e., the hydrophobic ultrafine particle form of titanium oxide was changed from A to C. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 11

Magnetic toner particles were obtained following Example 5 with the exception that the hydrophobic ultrafine particle form of titanium oxide A was excluded from the external additives. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 12

Magnetic toner particles were obtained following Example 5 with the exception that the external additive, i.e., the hydrophobic ultrafine particle form of titanium oxide was changed from A to D. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 13

Magnetic toner particles were obtained following Example 5 with the exception that the external additive, i.e., the hydrophobic ultrafine particle form of titanium oxide was changed from A to E. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 14

Magnetic toner particles were obtained following Example 5 with the exception that the external additive, i.e., the hydrophobic ultrafine particle form of titanium oxide was changed from A to F. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 15

Magnetic toner particles were obtained following Example 5 with the exception that the external additive, i.e., the hydrophobic ultrafine particle form of titanium oxide was changed from A to G. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 16

Magnetic toner particles were obtained following Example 5 with the exception that the external additive, i.e., the hydrophobic ultrafine particle form of titanium oxide was changed from A to H. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 17

Magnetic toner particles were obtained following Example 5 with the exception that the external additive, i.e., the hydrophobic ultrafine particle form of titanium oxide was changed from A to I. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 18

Magnetic toner particles were obtained following Example 5 with the exception that the external additive, i.e., the hydrophobic ultrafine particle form of titanium oxide was changed from A to J. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 19

Magnetic toner particles were obtained following Example 5 with the exception that the external additive, i.e., the hydrophobic ultrafine particle form of titanium oxide was changed from A to K. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 20

Magnetic toner particles were obtained following Example 5 with the exception that the amount of the external additive, i.e., the hydrophobic ultrafine particle form of titanium oxide A was changed to 0.5 parts by weight and the hydrophobic silica was not used. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Example 8

One hundred (100) parts by weight of the magnetic toner particles obtained in Example 5 were mixed with 25 parts by weight of the carrier particles 3 having an average particle diameter of 70 μm to prepare a developer.

Example 9

One hundred (100) parts by weight of the magnetic toner particles obtained in Example 5 were mixed with 25 parts by weight of the carrier particles 1 having an average particle diameter of 35 μm to prepare a developer.

Example 10

One hundred (100) parts by weight of the magnetic toner particles obtained in Example 5 were mixed with 15 parts by weight of the carrier particles 2 having an average particle diameter of 50 μm to prepare a developer.

Example 11

One hundred (100) parts by weight of the magnetic toner particles obtained in Example 5 were mixed with 35 parts by weight of the carrier particles 2 having an average particle diameter of 50 μm to prepare a developer.

Example 12

Magnetic toner particles were obtained following Example 5 with the exception that the amount of the external additive, i.e., the hydrophobic ultrafine particle form of titanium oxide A was changed from 0.1 part by weight to 1.2 parts by weight. The magnetic toner particles had an average particle diameter of 10 μm.

One hundred (100) parts by weight of the obtained magnetic toner particles were mixed with 25 parts by weight of the carrier particles 2 having an average particle diameter 50 μm, as in Example 5, thereby obtaining a developer.

Comparative Example 21

One hundred (100) parts by weight of the magnetic toner particles obtained in Example 5 were mixed with 5 parts by weight of the carrier particles 2 having an average particle diameter of 50 μm to prepare a developer.

Comparative Example 22

One hundred (100) parts by weight of the magnetic toner particles obtained in Example 5 were mixed with 50 parts by weight of the carrier particles 2 having an average particle diameter of 50 μm to prepare a developer.

Printing Test

Using a commercially available laser beam printer (6 sheets per minute) together with each of the developers obtained as mentioned above, 3,000 sheets were printed to make estimation of image density, image quality and solid black image tone variation at the end of 1st, and 3,000th printing, at normal temperature and humidity (20° C. and 60% RH), and at high temperature and humidity (32.5° C. and 80% RH), respectively. Transfer efficiency, too, was estimated at normal temperature and humidity.

Estimation was done by intermittent printing tests.

By the term "intermitted printing tests" is intended a testing method wherein data is transmitted to the printer and another data is again transmitted thereto at a certain time interval (of a few seconds), during which the printer is in no operation.

Set out below are measuring, and estimating procedures.

The image density was measured and estimated using a reflection densitometer (Macbeth Co., Ltd.).

The transfer efficiency is a value relating to the amount of toner consumed, and is given by $$\text{Transfer efficiency } (\%)=[(A-B)/A]\times 100$$

where A (g) is the amount of toner consumed, and B (g) is the amount of waste toner. A transfer efficiency of 70% or higher is regarded as being good. The transfer efficiency of 70% or higher is tantamount to a level of 90% or higher under ordinary printing conditions that are not applied to intermittent printing.

The image quality inclusive of fogging of non-image areas, toner scattering, breaks in printed characters, and resolution was evaluated in terms of five ratings or double circle, circle, triangle, black triangle, and cross marks, with the double circle mark showing "excellent" and the cross "inferior". It is noted that the triangle mark shows that the sample is on a practically acceptable level.

The solid black image tone variation or a density variation of solid black patterns due to defective toner carrying was evaluated according to five ratings or double circle, circle, triangle, black triangle, and cross marks with the double circle mark showing "excellent" and the cross "inferior". It is noted that the triangle mark shows that the sample is on a practically acceptable level.

The results are reported in Table 4.

TABLE 4

| | | | Normal temperature and humidity | | | | | High temperature and humidity | | |
|---|---|---|---|---|---|---|---|---|---|---|
| | Ti Oxide | Silica | 1st | | 3,000th | | Transfer | | 1st | Solid |
| | pbw | pbw | Density | Quality | Density | Quality | efficiency | Density | Quality | Black |
| Ex. 5 | A(0.1) | 0.5 | 1.48 | ◎ | 1.46 | ◎ | 78.2 | 1.38 | ○ | ◎ |
| 6 | B(0.1) | 0.5 | 1.47 | ◎ | 1.43 | ○ | 73.6 | 1.40 | ◎ | ◎ |
| 7 | C(0.1) | 0.5 | 1.50 | ◎ | 1.44 | ◎ | 75.4 | 1.37 | ○ | ○ |
| Comp. Ex. 11*** | — | 0.5 | 1.45 | ○ | 1.36 | Δ | 65.1 | 1.35 | ▲ | X |
| 12 | D(0.1) | 0.5 | 1.47 | ◎ | 1.40 | ▲ | 60.5 | 1.34 | ○ | Δ |

TABLE 4-continued

| | Ti Oxide | Silica | Normal temperature and humidity | | | | | High temperature and humidity | | |
|---|---|---|---|---|---|---|---|---|---|---|
| | | | 1st | | 3,000th | | Transfer | | 1st | Solid |
| | pbw | pbw | Density | Quality | Density | Quality | efficiency | Density | Quality | Black |
| 13 | E(0.1) | 0.5 | 1.44 | ○ | 1.31 | ▲ | 63.0 | 1.30 | Δ | ▲ |
| 14 | F(0.1) | 0.5 | 1.46 | ○ | 1.38 | ○ | 67.2 | 1.16 | X | X |
| 15 | G(0.1) | 0.5 | 1.45 | ◎ | 1.34 | ▲ | 62.0 | 1.41 | ○ | Δ |
| 16 | H(0.1) | 0.5 | 1.42 | ○ | 1.31 | Δ | 58.4 | 1.30 | ▲ | ▲ |
| 17 | I(0.1) | 0.5 | 1.45 | ○ | 1.40 | ▲ | 63.1 | 1.34 | ○ | Δ |
| 18 | J(0.1) | 0.5 | 1.46 | ◎ | 1.32 | ▲ | 59.2 | 1.36 | ○ | ▲ |
| 19 | K(0.1) | 0.5 | 1.47 | ◎ | 1.35 | Δ | 63.7 | 1.33 | ○ | ▲ |
| 20 | A(0.5) | — | 1.25 | ▲ | 1.08 | X | 52.1 | 1.18 | ▲ | X |
| Ex. 8 | A(0.1) | 0.5 | 1.49 | ○ | 1.48 | ○ | 70.3 | 1.42 | ○ | ○ |
| 9 | A(0.1) | 0.5 | 1.43 | ◎ | 1.39 | ○ | 78.4 | 1.37 | ○ | ○ |
| 10 | A(0.1) | 0.5 | 1.48 | ◎ | 1.44 | ◎ | 72.4 | 1.42 | ○ | ○ |
| 11 | A(0.1) | 0.5 | 1.40 | ○ | 1.37 | ○ | 70.9 | 1.38 | ○ | ◎ |
| 12 | A(1.2) | 0.5 | 1.40 | ○ | 1.36 | Δ | 71.1 | 1.37 | ○ | Δ |
| Comp. Ex. 21** | A(0.1) | 0.5 | 1.53 | Δ | 1.43 | ▲ | 73.1 | 1.44 | Δ | ▲ |
| 22 | A(0.1) | 0.5 | 1.41 | ○ | 1.35 | ▲ | 60.1 | 1.35 | Δ | ○ |

** The carrier/toner quantitative ratio departs from the scope of the invention.
***Fogging was also observed at 10W temperature and humidity (10° C. and 20% RH).

The effectiveness of the present invention is evident from Table 4. In this regard, it is noted that in the developer of comparative example 1 considerable fogging was observed at low temperature and humidity (10° C. and 20% RH).

Examples 5 to 11 were repeated with the exception that the fatty acid aluminum used in preparing the external additive for the magnetic toner particles, i.e., the hydrophobic ultrafine particle form of titanium oxide was changed from aluminum stearate to aluminum compounds of pentadecylic acid, palmitic acid, heptadecylic acid, and arachic acid, respectively. Satisfactory results equivalent to those of Examples 5 to 11 were obtained.

The electrophotographic magnetic toner according to the present invention is improved in terms of fluidity and charge stability because, as explained above, the toner particle contains hydrophobic silica and an ultrafine particle form of titanium oxide which is made hydrophobic on its surface by surface treatment with the fatty acid aluminum and so is improved in terms of the effect on imparting dispersibility and fluidity to the toner particle. Therefore, the electrophotographic magnetic toner according to the present invention can provide images of high density and high quality over an extended period of time, with no filming on the surface of a photosensitive material.

The electrophotographic developer according to the present invention has improved fluidity and charge stability because, as explained above, the magnetic toner particle contains hydrophobic silica and an ultrafine particle form of titanium oxide which is made hydrophobic on its surface by surface treatment with the fatty acid aluminum and so is improved in terms of the effect on imparting dispersibility and fluidity to the toner particle. Therefore, the electrophotographic developer according to the present invention has good-enough transfer efficiency, and can provide images of high density and high quality over an extended period of time, said images being free from solid black image tone variations even at high temperature and humidity.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but the invention will include all embodiments falling within the scope of the appended claims.

What we claim is:

1. A magnetic toner for electrophotography comprising a toner particle containing at least a binder resin and a magnetic powder, and an additive, wherein:

said additive comprises an ultrafine particle form of titanium oxide treated on a surface thereof with an aluminum compound of a fatty acid to make said surface hydrophobic, and a hydrophobic silica, and said ultrafine particle form of titanium oxide has a specific surface area of 80 to 120 $m^2/g$, a degree of hydrophobicity of 50 to 80% by weight, and an alumina content of 0.4 to 1.1% by weight.

2. The magnetic toner of claim 1, wherein a fatty acid moiety of said aluminum compound of a fatty acid has 15 to 20 carbon atoms.

3. The magnetic toner of claim 1, wherein said ultrafine particle form of titanium oxide is added to said magnetic toner in an amount of less than 1% by weight.

4. The magnetic toner of claim 1, which has an average particle diameter of 5 to 12 $\mu$m.

5. A developer for electrophotography obtained by mixing a magnetic toner particle containing at least a binder resin and a magnetic powder with a carrier particle, wherein:

said toner particle comprises an ultrafine particle form of titanium oxide treated on a surface thereof with an aluminum compound of a fatty acid to make said surface hydrophobic, and a hydrophobic silica, said ultrafine particle form of titanium oxide has a specific surface area of 80 to 120 $m^2/g$, a degree of hydrophobicity of 50 to 80% by weight, and an alumina content of 0.4 to 1.1% by weight, and 10 to 40 parts by weight of said carrier particle are mixed with 100 parts by weight of said magnetic toner particle.

6. The developer of claim 5, wherein a fatty acid moiety of said aluminum compound of a fatty acid has 15 to 20 carbon atoms.

7. The developer of claim 5, wherein an amount of said ultrafine particle form of titanium oxide added onto said magnetic toner particle is less than 1% by weight.

8. The developer of claim 5, wherein said magnetic toner particle has an average particle diameter of 5 to 12 $\mu$m.

9. The developer of claim 5, wherein said carrier particle has an average particle diameter of 10 to 100 $\mu$m.

* * * * *